United States Patent [19]

Ward

[11] 4,394,049

[45] Jul. 19, 1983

[54] KNEELING AID DEVICE

[76] Inventor: Fred A. Ward, R.R. #1, Cairo, Mo. 65239

[21] Appl. No.: 164,310

[22] Filed: Jun. 30, 1980

[51] Int. Cl.[3] ..... A47C 9/12

[52] U.S. Cl. ..... 297/439; 297/411

[58] Field of Search ..... 297/439, 423, 187, 411, 297/416; 280/32.6, 32.5, 47.19, 47.24

[56] References Cited

U.S. PATENT DOCUMENTS

| | | | |
|---|---|---|---|
| 1,369,780 | 3/1921 | Burgess | 280/32.5 |
| 2,139,470 | 12/1938 | Schmeiser | 280/47.24 |
| 2,363,619 | 11/1944 | Prieto | 280/47.19 X |
| 2,798,732 | 7/1957 | Craig | 297/439 X |
| 2,815,067 | 12/1957 | Richardson | 297/416 X |
| 2,829,705 | 4/1958 | Godshalk et al. | 297/439 X |
| 3,656,809 | 4/1972 | Ronning | 297/439 |
| 4,222,559 | 9/1980 | Hammer | 297/439 |

FOREIGN PATENT DOCUMENTS

| | | | |
|---|---|---|---|
| 2045071 | 10/1980 | United Kingdom | 297/187 |

*Primary Examiner*—Francis K. Zugel

*Attorney, Agent, or Firm*—Thomas M. Scofield

[57] ABSTRACT

Improvements in kneeling devices, knee rests and knee cushions, as well as kneeling stools; kneeling devices with multi-level arms to facilitate kneeling and rising therefrom; devices operative to facilitate work in a kneeling position such as gardening, meditation and prayer.

3 Claims, 9 Drawing Figures

KNEELING AID DEVICE

BACKGROUND OF THE INVENTION

Numerous human activities require the assumption of a kneeling posture for considerable intervals of time. Such include, without limitation, gardening, prayer, meditation, cleaning floor areas, carpentry and the like. Such activities, if carried on for extended intervals of time, typically call for the use of cushions, pads or the like which would protect the knees of the person active in such endeavors. Numerous prior art devices are directed to this problem as is exemplified by the patents recited herebelow.

With respect to older and handicapped people, particularly, not only the act of kneeling itself for any extended period, but also the assumption of and the recovery from such posture may be very difficult, indeed painful. The knee rest, gardener's stools, kneeling stools and cushion constructions of which the writer is aware do not adequately provide for or meet such requirements or needs. What is optimally required is a knee rest or cushion of strong base construction and comfortable pad which has a base particularly adapted to the use to which the device is to be directed, there additionally being provided arms facilitating kneeling down and rising from a kneeling posture. In addition, the entire device should be readily portable in a manner which does not require carrying and also one which provides tool storage space or shelf space if desirable in a particular application. This is what I have attempted to provide in this invention and have so provided.

BRIEF DESCRIPTION OF THE INVENTION

The subject device constitutes a padded platform received on a low supporting base. This base may be varied in construction, depending upon the degree of support required. Thus it may extend completely across the bottom of the cushion platform, along the sides, or along the length thereof, as necessary. Considerable support may be required if the device is to be used for gardening or related pursuits where soil or lawn support is required.

Associated with the padded platform on the low supporting base are a pair of grasping bars, the first of them relatively high or of greater height, the second low or of lesser height. The purpose of the high grasping bar is first for locomotion of the device, and also for grasping by one of the user's hands when kneeling or rising therefrom. The second, lower grip is for the other hand grip when the user is kneeling or rising.

What I have discovered is that a poorly ambulant, injured, crippled or limited motion user is not able to easily or successfully use two high grips or two lower grips, per se, to successfully get up and down from kneeling. Instead, I have discovered that the two different height grips or gripping bars (and their supporting means) make possible kneeling and getting up therefrom with much greater facility. These considerations also apply to overweight people or yet to people who merely want the security and convenience of gripping bars.

The device itself is reversible merely by turning it around for different handed persons, or sided persons, such as with a leg or arm injury. Alternatively, I provide two high bar grips each having an intermediate grip so that it is not necessary to manipulate or turn the device around for a person of either handedness. I additionally supply means (such as wheel mounting) for locomotion of the device on the high bar side of the device or both sides of the device in case of paired high bars as noted. Finally, the bars may be adjustable and inwardly inclined for greater versatility and people of different sizes or, in the latter case, where a wise base and cushion are employed.

THE PRIOR ART

I am aware of the following patents directed to knee cushions, knee rests, kneeling stools, gardener kneeling devices and the like:

Rundell U.S. Pat No. 830,103, issued Sept. 4, 1906 for "Knee Cushion;"

Burgess U.S. Pat. No. 1,369,780, issued Mar. 1, 1921 for "Scrub Cart;"

Novak U.S. Pat. No. 1,529,498, "Knee Rest", issued Mar. 10, 1925;

Hoover, et al., U.S. Pat. No. 1,976,170, "Knee Rest," issued Oct. 9, 1934;

Holzderber U.S. Pat. No. 2,225,696, "Kneeling Stool," issued Dec. 24, 1940;

Peirce U.S. Pat. No. 2,318,416, "Kneeling Stool," issued May 4, 1943;

Gogshalk, et al., U.S. Pat. No. 2,829,705 "Gardener's Utensil," issued Apr. 8, 1958.

OBJECTS OF THE INVENTION

A first object of the invention is to provide an improved kneeling device which is particularly adaptable to use for and by aging persons, crippled or injured persons, people of limited strength, overweight persons and the like, both the kneeling and the rising therefrom being facilitated by the improved structure. The device is also a great convenience and aid for the ordinary person or worker.

Another object of the invention is to provide a handy, useful, relatively inexpensive, versatile device for kneeling purposes, to be used in prayer, meditation, gardening, floor cleaning and like activities where not only is the kneeling, per se, made as efficient as possible, but also the handling and moving of the device, as well as the kneeling process and rising therefrom.

Another object of the invention is to provide an improved kneeling device which may be used by persons of either handedness or sidedness, this feature being provided by grasping bars and support therefor of different levels or two high grasping bars, one or both with intermediate grasping means.

Another object of the invention is to provide improvements in kneeling devices utilizing grasping arms to facilitate kneeling and rising therefrom which are optionally variable in height and optionally inwardly inclined for smaller or particularly handicapped people, as well as wide bases and cushions. The latter mentioned inward inclination also aids in center of gravity considerations.

Another object of the invention is to provide a device of the character described which is very well adapted to the purposes indicated and will permit people, to whom such activity has heretofore been essentially denied, to perform activities requiring kneeling for brief or extended intervals of time and enable people having limited physical capacity to both kneel and rise therefrom with relative and greatly increased ease.

Other and further objects of the invention will appear in the course of the following description thereof.

THE DRAWINGS

In the drawings, which form a part of the instant specification and are to be read in conjunction therewith, embodiments of these invention are shown and, in the various views, like numerals are employed to indicate like parts.

FIGS. 1–5, INCLUSIVE

Referring first to FIGS. 1–5, inclusive, therein is shown a first and preferred form of the invention of most simplified form. This construction basically comprises:

(1) A kneeling platform with a cushion thereon;

(2) A bail or handle member on each end of the platform for grasping when kneeling down on the platform or rising therefrom;

(3) Base members underneath the platform to support it on a normally horizontal surface or the ground; and (4) Wheel means to aid in dragging or moving the device across such normally horizontal surface.

(5) Accessories such as a container or shelf for holding work for reading articles.

The noted elements may be of varying construction, as will be described below, but are optimally constructed as illustrated and herebelow described.

Figure 3:
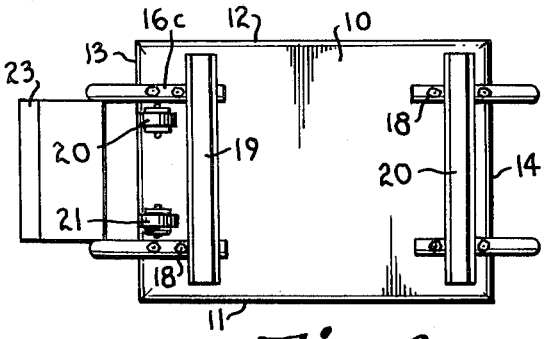
FIG. 3 is a bottom view of the device of FIGS. 1 and 2.

Referring first to FIG. 3, the kneeling platform may readily comprise a rectangular piece of plastic, metal or wood 10 having (for purposes of description) a forward edge 11 (or side), a rearward edge or side 12 and side edges 13 and 14. Specifically, member 10 must provide a rigid, normally horizontal frame having upper and lower sides thereto and forward, rear and side edges. Preferably, since the platform is for kneeling purposes, it will have greater width (from edge 13 to edge 14) than depth (from edge 11 to edge 12). It may be conveniently oval or rectangular, the latter shown.

Platform 10 is the basic structural frame or support to which all the other elements are attached and must be of good strength to support the user's weight in kneeling and the bails which are grasped by the user in kneeling and rising must be (once adjusted if adjustable) rigidly fixed relative thereto.

The cushion 15, of foam platic, foam rubber or any convenient resilient material, may be fixed thereto, such as by a plastic sheet or cover which may be glued or nailed to the platform at its sides or underside. The latter is not shown in detail in the views. Other materials and fastenings for the cover such as strong cloth and stapling may be used.

A pair of normally substantially vertical bail members generally designated 16 and 17 are connected to the platform or base frame and positioned one adjacent each side edge 13 and 14 thereof in opposition to one another. Either the width of the platform 10 or the distance apart of the vertical bail members, or both, must leave substantial space therebetween for a person to kneel on the upper surface of the cushion 15 on platform or base 10. Said otherwise, the platform 10 and cushion 15 should be of sufficient width and depth that a person's knees can be comfortably received thereon in normal kneeling position. The bail members 16 and 17, in the vertical portions thereof, must be sufficiently widely spaced apart that a person's shoulders may comfortably fit therebetween when that person is in a kneeling position.

The specific bail members illustrated in FIGS. 1–5, inclusive are inverted U-shape in their vertical portions and L-shaped (FIG. 2) in end elevation. This construction provides top arcuate hand grasping portions **16*a* and 17*a*, as well as paired vertical leg portions 16*b* and 17*b* and paired, inwardly extending base portions 16*c* and 17*c*, respectively. The latter, in the construction shown, pass inwardly under the platform or base frame 10 and are removably secured thereto by screws or bolts 18. As may be seen from the views, the bail member 17 is of substantially less height than the bail member 16**, although otherwise they are substantially identical.

Figure 1:
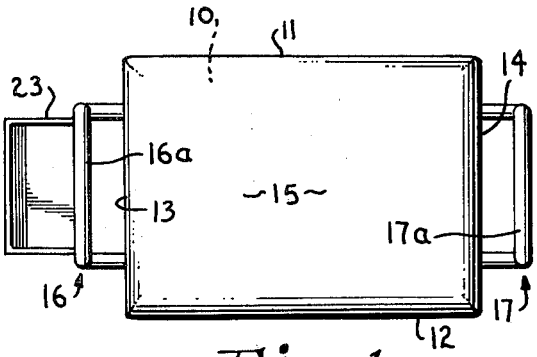
FIG. 1 is a top plan view of a preferred form of the subject device.
Figure 2:
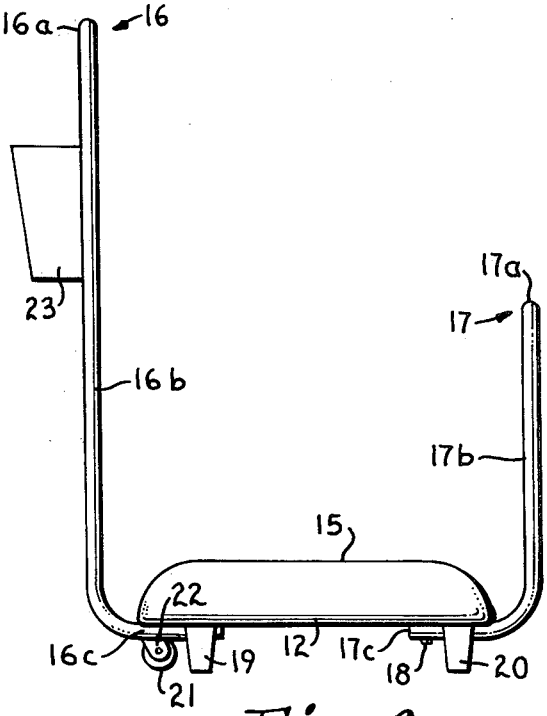
FIG. 2 is a front view of the device of FIG. 1.
Figure 4:
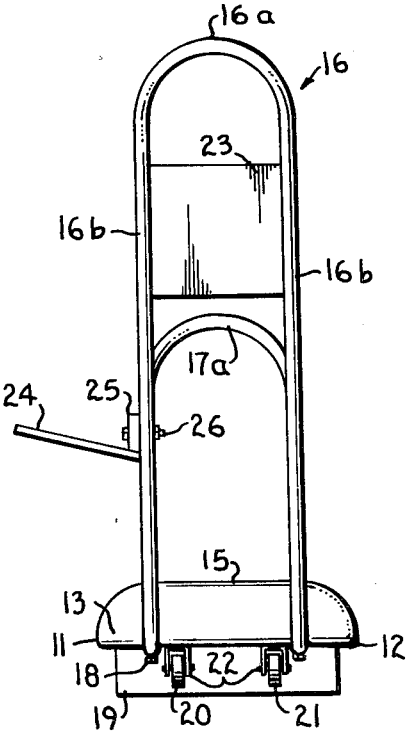
FIG. 4 is a side view of the device of FIGS. 1–3, inclusive taken from the left side of FIG. 2 looking to the right in the view. A shelf to receive work or reading materials has been added in this view and that of FIG. 5.
Figure 5:
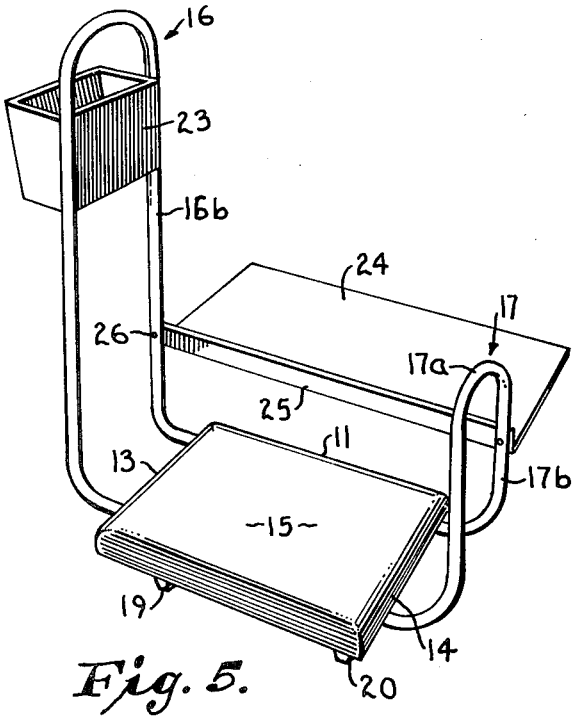
FIG. 5 is a three quarter perspective view of the device of FIGS. 1–4, inclusive taken from above and slightly to the left of the device as seen in FIG. 2.

Referring particularly to FIGS. 2, 3 and 4, therein are shown two elongate base or leg members 19 and 20 which, in the form shown, extend forwardly and rearwardly of platform 10 and overlie portions of the inwardly extending leg portions **16*c* and 17*c* of bail members 16 and 17. Finally, wheels 20 and 21 are rotatably received in conventional pivotal frames 22 outboard of leg or support member 19 and on the high bail member 16 side. A container or box 23 for holding reading materials, work materials, gardening tools or the like may be removably or fixedly attached to one of the bail members, most readily bail member 16 as may be seen in the views. Also optionally and additionally, a platform 24 (as is seen in FIGS. 4 and 5) for work materials or reading materials, such as in meditation or prayer, may be removably fixed to one vertical member 16*b* and 17*b* of bail members 16 and 17 as by a base 25 and bolts or screws 26**. The wheel frames may be fixed along the axis of the base and the whels may be wide or narrow.

In operation of the device of FIGS. 1–5, inclusive, the user transports the deiice to the locale or area where it is desired to be used by grasping the top portion **16*a* of longer bail member 16 and tilting it to the left in the view of FIG. 2. In this manner, wheels 20 and 21** can bear on any horizontal floor or ground surface or, for that matter, inclined surfaces and permit the user to transport the device, in the tilted position, across the surface.

When the desired locale is reached, the device is returned to its resting position on members 19 and 20. The user (referring now to the limited access version of FIGS. 4 and 5) first grasps the top portion **16*a* of bail member 16 with his left hand, then bends over from the waist and grasps portion 17*a* of member 17** with his right hand. He (or she) then drops one knee, perhaps the knee closest the higher bail member, first to the cushion or pad, then the other one. During this kneeling operation, a first arm (here the right arm) is more extended, while the left arm (in the case described) is more bent.

Actually, in the kneeling operation, a person may tend to favor his handedness. Thus, a right handed person typically may tend to lower the right knee first, whichever bail member is grasped by the right hand. This may depend, also, upon the condition of the individual's legs or arms, or both, or total physical condition. The one thing that is certain is that, if a person able to kneel at all, the present device will greatly facilitate kneeling and rising therefrom.

In the device of FIGS. 4 and 5, handedness or a person's condition may dictate to which side the platform 24 is attached. However, in the device of FIGS. 1–5, inclusive, without such a platform 24 impeding one side of the device, it should be noted that simply reversing the device places the high bail member at the user's other hand from an original position. Thus, the device readily is adapted at a locale to the handedness or physical condition of a user by simply turning the device around. On the other hand, if the platform 24 is to be applied, it may be placed in a planned position so as to facilitate kneeling and rising, or the convenience of a given person in a given situation.

In the act of kneeling, the user, standing essentially erect, grasps the higher bail member. Then, bending from the waist, with the other hand, he grasps the upper end of the other bail member. At this point, with the high grasping arm quite bend and the low grasping arm quite straight, one knee can be lowered easily and safely to the cushion and then the other. Then the user may work, pray, meditate, garden, etc., until ready to rise.

At this point, the reverse occurs, that is, the user typically grasps the lower bail member to fully straighten up on both knees. Then, grasping the higher bail member with the one hand, one knee, typically next to the high bail member, is raised and, pushing down on the lower bail member and steadying with the higher bail member grasp, the user readily rises to a standing position.

When one has not been injured, crippled, overweight, or is not aged, the problem of kneeling and rising therefrom is sometimes not seen in its true magnitude. Specifically, persons with these conditions often are not able to kneel and rise therefrom without special help. Even a relatively healthy person, however, when faced with a task such as scrubbing a floor, having to kneel and rise therefrom over and over, and work hard in a knealing position, may find this device extremely helpful or almost necessary in order to be able to work a relatively long time with relative ease and comfort. The essence of applicant's development is the staged control of effort in kneeling and rising therefrom. Thus, the first grip on the high bail enables a relatively easy stoop or lean to grasp the lower bail in kneeling. With both bails grasped and the user steadying himself thereby in leaning position, it is but a slight step to lower one knee to the cushion, carrying the weight largely in the arms. Once one knee is down, stabilized by the bail grasps, the other knee easily may go down, permitting release of the bail members and leaning over to the full work position thereafter. The bails facilitate the user's shifting position, as well, once kneeling.

The reverse is true, with a first grasp of the low bail member, then a grasp of the high bail member, a lift of one knee, then the rise to a standing, but leaning supported position and then to full free stand.

It should be noted that both the leg members 19 and 20 and wheels 20 and 21, provided the user does not mind carrying the device from one place to another, are not necessary. It is evident that the device can rest on the base of the platform 10 or, assuming the specific bail structure is present part as seen in the drawings, on the underside portions 16*c* and 17*c* of the bails 16 and 17. It is the provision of the platform and the different height bail members on the sides thereof which is critical to applicant's invention. The base members and wheel transport means are useful, but not necessary in all applications. A certain platform thickness (to ground support) of three or more inches may help comfort because of foot length. The supporting base structure may be varied as desired or required for the type of surface support to be encountered.

In order to give an idea of optimum scale, but not limiting, the depth of the platform may be 13 inches and width 19 inches. The width between the bail members may be 26 inches. The height of the longer bail member from floor support level may be 33 to 34 inches and the like height of the lower bail member 17 to 18 inches. In the specific construction shown, the distance apart of the vertical portions of the bail members may be 8½ inches. These particular dimensions may be varied as required, but will suffice for, for example, a man up to 6 feet 2 inches with quite broad shoulders.

The device thus described comprises, typically:

(1) A rigid, normally horizontal frame or platform having upper and lower sides thereto, typically of greater width and depth, thus having substantially forward, rearward and side edges.

(2) A pair of normally substantially vertical bail members are provided connected to the frame or platform, positioned one adjacent each side edge thereof in opposition to one another, leaving substantial space therebetween for a person to kneel on the upper surface of the frame or platform therebetween.

(3) The upper portions of each of the bail members are positioned substantially above the frame or platform and are adapted for grasping, each by one hand of the user of the device, in kneeling down thereon or rising up therefrom.

(4) One of the bail members has a relatively higher grasping portion to be grasped by one hand of the user and the other of the bail members has a relatively lower grasping portion to be grasped by the other hand of the user.

(5) The relatively lower grasping portion of one bail member is so positioned and located in height as to bear a preponderance of the user's weight and more support the user when the user, grasping both bail members with separate hands, is substantially in kneeling position or beginning to rise therefrom to a standing position.

(6) The relatively higher grasping portion of the other bail member is so positioned and located in height as to bear a preponderance of the user's weight and relatively more substantially support the user when the user, grasping both bail members with separate hands, is beginning to kneel downwardly to the platform from a standing position or has substantially risen upwardly from the platform to a standing position.

DEVICE OF FIG. 6

Figure 6:
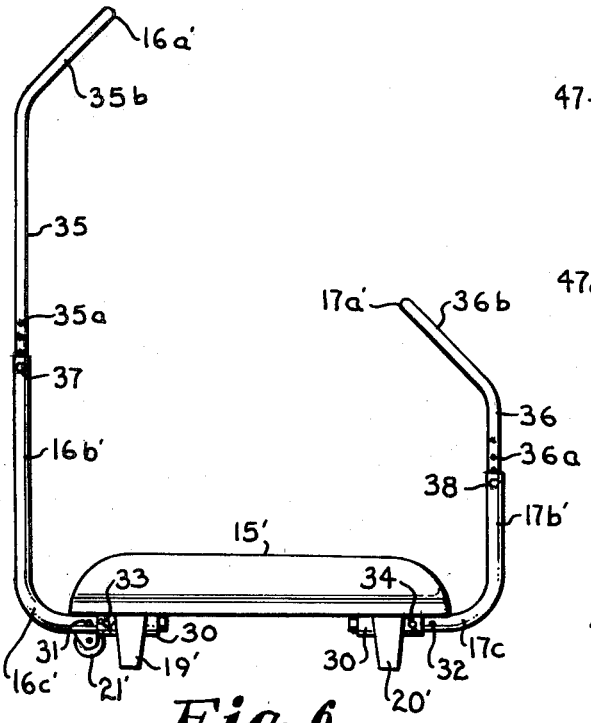
FIG. 6 is a front view of a modified form of the device showing variable height grasping arms and inwardly inclined grasping arms.

Turning to FIG. 6, therein is seen a device identical to the device of FIGS. 1–5, inclusive save for three features:

(1) The upper portions of the bail members are inwardly inclined; and (2) The bail members are vertically adjustable in height intermediate their ends.

Accordingly, all of the parts of the device except the different parts are numbered the same, but primed. These parts will not be redescribed. Additionally:

(3) The lateral extension of the bail members is adjustable at their platform or base connection.

With respect to the lateral adjustment of the bail members, sleeves 30, two in number on each side are provided, in the specific case shown, extending through base members 19' and 20'. Sleeves 30 receive the inwardly extending lower ends 16c' and 17c' therethrough. Holes or openings 31 and 32 through the bail member inwardly extending ends are engageable by pins 33 and 34, thus to fix the lateral outward or inward extension of the lower members of the bails. Thus feature also permits removal of the bails for unit storage and transport.

With respect to the vertical adjustment of the bail members, the lower vertical portions 16b' and 17b' of the bail members are cut off intermediate the normal heights thereof so as to be able to receive, slidingly therewithin, the upper portions, respectively, 35 ad 36, of the respective bail members. Holes 35a are provided in the lower end of upper bail portion 35 and 36a in the lower portion of bail member 36. Pins 37 and 38, removably engaging openings 35a and 36a, respectively, give limited adjustment in height to the bail members. This height adjustment is available independent of the width adjustment or therewith or independent of the inwardly inclined ends to be described or therewith.

In FIG. 6, there are shown upper portions 35b and 36b of the upper bail member portions 35 and 36, which each have been inwardly inclined. It is optional to provide one or both members inwardly inclined, depending upon the physical condition of the user. When there is an exceptionally wide kneeling platform, it may be desirable to have both bail members inwardly inclined as shown. By reversing either upper portion 35 or 36 with respect to the other on outboard inclination may be achieved. The slope may be lesser than shown, for inclined members.

The three changes shown in FIG. 6 make possible great versatility in the device. With each bail member separately laterally adjustable and separately vertically adjustable, the height and width adjustments can be made very precise for a given individual. The presence of one or more inwardly inclined bail members as shown in FIG. 6 adapts to other particular conditions of user condition or platform size width. Portability and stowability are enhanced.

FIGS. 7–9, INCLUSIVE

In this construction, a device is provided which adapts to handedness or variable user condition without having to reverse the device. That is, each side of the device has a high bail member grasping portion and a low bail member grasping portion. This device additionally gives particularly effected or disabled users two low grasps for use in kneeling or rising therefrom, moving the device or moving one's body around the device when in kneeling position.

Referring, then to these figures, there is a platform or frame 40 having a cushion or pad 41 thereon. Leg or support members 42 and 43 are structured the same as members 19 and 20 of FIGS. 1–5, inclusive with respect to the platform. Wheels 44 and 45 are received in the conventional pivoting frames (not numbered), in rotatable fashion to one side of support leg or beam 42. The described constructions are the same as those seen in FIGS. 1–5, inclusive.

Fixed to the underside of platform 40 in the same manner as in FIGS. 1–5, inclusive are two bail members generally designated 46 and 47. These are both high bail members and have upper grasping ends 46a (47a), paired intermediate vertical portions 46b (47b) and inwardly extending paired lower end members 46c (47c). Bolts or screws 48 fixedly attach (or removably) bail membes 46 and 47 to platform 40 in paired, opposed manner as previously described with respect to FIGS. 1–5, inclusive.

Intermediate the upper and lower ends of vertical portions 46b and 47b of bails 46 and 47 are provided opposed openings 46d and 47d. These may be from one in number (in sets) on each side to several or many on each side for vertical adjustability. Therethrough, elongate bolts 49 and 50 extend the entire width of the paired bail members, receiving sleeves 51 and 52 thereover between the paired vertical bail members and locking pins or nuts 53 at the other ends thereof.

The middle positions of the intermediate grasping portions (sleeves 51 and 52) are preferably at a height substantially equal to that of bail 17a with respect to bail portions 16a in FIGS. 1–5, inclusive.

Figure 7:
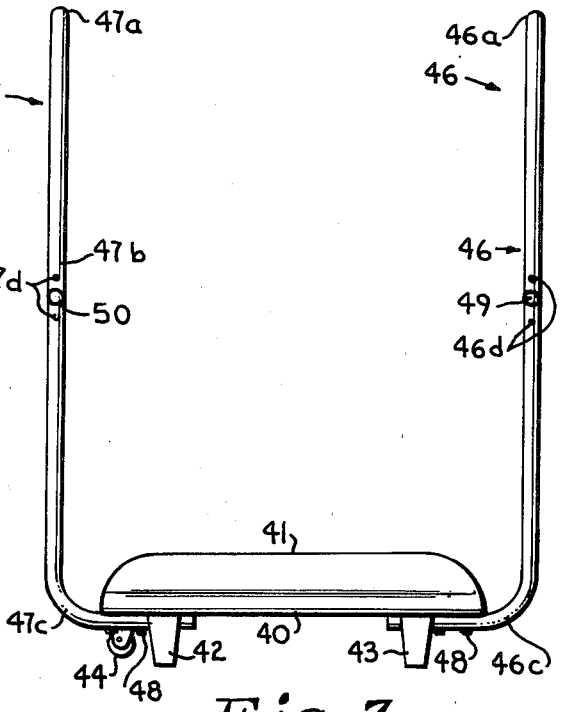
FIG. 7 is a front view of a third form of the device showing two high bar grasping elements with intermediate grasping elements on each high bar frame.
Figure 8:
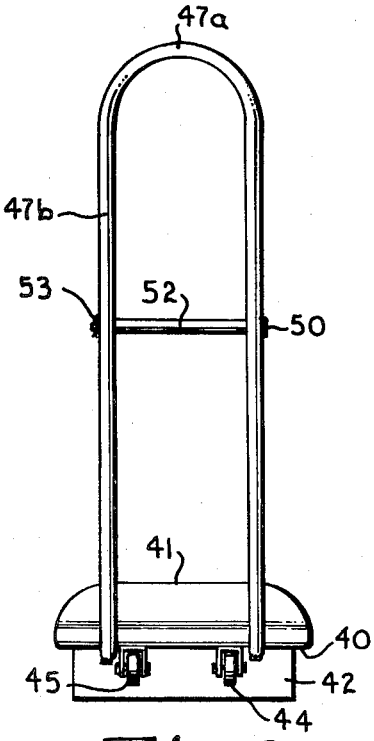
FIG. 8 is an end view of the device of FIG. 7 taken from the left and looking to the right in view of FIG. 7.
Figure 9:
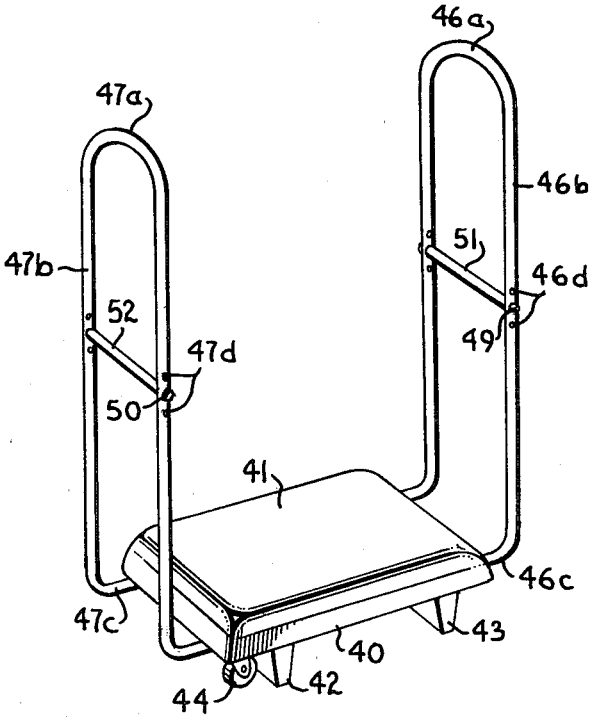
FIG. 9 is a three quarter perspective view of the device of FIGS. 7 and 8 from above.

In use or operation of the device in FIGS. 7–9, inclusive, the user again first grasps, with one hand, an upper bail portion 46a and 47a, then leans over to grasp with the other hand the intermediate portion 51 or 52. The user then kneels down with one knee, supporting his weight from the grasped upper and intermediate bail portions, then lowering the other knee. To rise, the sequence is reversed, grasping the intermediate bail portion, typically, first, then the upper bail portion.

The device of FIGS. 7–9, inclusive has, respectively, advantages and disadvantages. That is, if the user finds it easier to kneel down grasping certain bail portions and rise up grasping opposite bail portions, then the device of these figures readily lends itself to such use. In such case using the previously described devices, the user must, once kneeled, get off the cushion and reverse the device, before rising, to have this advantage. On the other hand, the space above the intermediate bail portion which is being used, or lower bail portion being used, is more restricted with respect to the user's arm and elbow and thus less advantageous from that standpoint.

Yet further, the device in question permits relative adjustment of the two lower bail grasping portions, which may be advantageous in certain user conditions. As previously mentioned, the device does not need to be reversed or the user get off the device to have full versatility of grasping elements.

While the platform and cushion have been shown as rectangular and described additionally as oval, clearly the platform may be of any shape. Extension of the platform, forwardly, rearwardly or to the side of the bail members on one or both sides may be advantageous for certain uses or applications. What is invariable is the desire and necessity to have the kneeling pad between the bail members, the bail members being sufficiently separated for proper arm use.

While the bail members are optimally as shown and described in the figures, thus giving strength, breadth for grasping and four point weight transmittal into the platform and supporting base, single beam members or rods with right angle grasping bars or loops may additionally be provided. The latter are preferable to crossed grasping bars as any free points or ends are to be avoided if at all possible.

With respect to the leg members, if such are employed, preferably they extend forwardly and rearwardly of the bail member attachments to the platform for greater stability. If base constructions are employed as seen, lengthwise like members may be employed to give greater area support and also greater stability. The latter described structure is a box enclosure of right angle beam members outboard of the bail connection. Alternatively, the base extending down below the platform may be itself solid or a subplatform carried by supports to give broader surface support, such as in ground or soil use and support.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A kneeling device, comprising, in combination:

(a) a rigid, normally horizontal frame having upper and lower sides thereto and of greater width than depth, whereas to have substantially forward, rear and side edges, (b) a pair of normally substantially vertical bail members rigidly connected to said frame and positioned with one bail adjacent each side edge thereof in opposition to one another, leaving subsubstantial space therebetween for a person to kneel on the upper surface of the frame therebetween without being in contact with either bail when kneeling, (c) upper portions of each of said bail members positioned substantially above the frame and having substantially horizontally oriented portions thereof adapted for grasping, each by one hand of a user of the device, in kneeling down thereon on rising up therefrom, (d) one of the bail members having a substantially relatively higher grasping portion to be grasped by one hand of the user and the other of the bail members having a substantially relatively lower grasping portion to be grasped by the other hand of the user, said grasping portions being said substantially horizontally oriented upper portions of said bail members, (e) the said relatively lower grasping portion of said one bail member so positioned and located in height as to require the initially standing user to lean or stoop to grasp same with one hand and to bear a preponderance of the user's weight and relatively more substantially support the user when the user, grasping both said bail grasping portions with separate hands, is substantially down in kneeling position or beginning to rise therefrom to a standing position, (f) the said relatively higher grasping portion of the other bail so positioned and located in height as to not require the initially standing user to stoop to grasp same with the other hand and to bear a preponderance of the user's weight and relatively more substantially support the user, when the user, grasping both said portions with separate hands, is beginning to kneel downwardly to the frame upper surface from a standing position or has substantially risen upwardly from the frame upper surface to a standing position, (g) two supporting leg members fixed to the underside of the frame and extending normally downwardly therefrom adapted to support the frame in a horizontal position spaced upwardly from a substantially horizontal supporting surface, said leg members being positioned closely adjacent the side edges of the frame, normal to the width axis thereof and extending substantially the depth thereof, (h) one of the bail members being of substantially greater height than the other, the said relatively higher bail grasping portion and relatively lower bail grasping portion comprising the uppermost parts of the respective bail members and (i) a pair of wheels rotatably mounted next to the side edges of the frame having the highest bail member thereat on the underside of the frame and outboard of the supporting leg member at that side of the frame, (j) the two supporting leg members fixed to the underside of the frame being of greater height than the downward extension of the wheels below said frame, whereby the frame may be tilted off the supporting leg members onto the said wheels by grasping the the higher bail member at the top thereof and tilting the frame at an angle to the supporting surface.

2. A kneeling device, comprising, in combination:

(a) a rigid, normally horizontal frame having upper and lower sides thereto and of greater width than depth, whereas to have substantially forward, rear and side edges, (b) a pair of normally substantially vertical bail members rigidly connected to said frame and positioned with one bail adjacent each side edge thereof in opposition to one another, leaving substantial space therebetween for a person to kneel on the upper surface of the frame therebetween without being in contact with either bail when kneeling, (c) upper portions of each of said bail members positioned substantially above the frame and having subtantially horizontally oriented portions thereof adapted for grasping, each by one hand of a user of the device, in kneeling down thereon or rising up therefrom, (d) one of the bail members having a substantially relatively higher grasping portion to be grasped by one hand of the user and the other of the bail members having a substantially relatively lower grasping portion to be grasped by the other hand of the user, said grasping portions being said substantially horizontally oriented upper portions of said bail members, (e) the said relatively lower grasping portion of said one bail member so positioned and located in height as to require the initially standing user to lean or stoop to grasp same with one hand and to bear a preponderance of the user's weight and relatively more substantially support the user when the user, grasping both said bail grasping portions with separate hands, is substantially down in kneeling position or beginning to rise therefrom to a standing position, (f) the said relatively higher grasping portion of the other bail so positioned and located in height as to not require the initially standing user to stoop to grasp same with the other hand and to bear a preponderance of the user's weight and relatively more substantially support the user, when the user, grasping both said portions with separate hands, is beginning to kneel downwardly to the frame upper surface from a standing position or has substantially risen upwardly from the frame upper surface to a standing position, (g) the bail members being each substantially inverted U-shape in side view of the frame and substantially L and J shaped in an end view of the frame and have the entire vertical length thereof laterally positioned of the side edges of said frame and also have the lowermost, base portion thereof fixed to the underside of the frame, (h) the bail members being of substantially different heights and the said relatively higher and relatively lower grasping portion each comprising the top of a respective bail member.

3. A kneeling device, comprising, in combination:

(a) a rigid, normally horizontal frame having upper and lower sides thereto and of greater width than depth, whereas to have substantially forward, rear and side edges, (b) a pair of normally substantially vertical bail members rigidly connected to said frame and positioned with one bail adjacent each side edge thereof in opposition to one another, leaving substantial space therebetween for a person to kneel on the upper surface of the frame therebetween without being in contact with either bail when kneeling, (c) upper portions of each of said bail members positioned substantially above the frame and having substantially horizontally oriented portions thereof adapted for grasping, each by one hand of a user of the device, in kneeling down thereon or rising up therefrom, (d) one of the bail members having a substantially relatively higher grasping portion to be grasped by one hand of the user and the other of the bail members having a substantially relatively lower grasping portion to be grasped by the other hand of the user, said grasping portions being said substantially horizontally oriented upper portions of said bail members, (e) the said relatively lower grasping portion of said one bail member so positioned and located in height as to require the initially standing user to lean or stoop to grasp same with one hand and to bear a preponderance of the user's weight and relatively more substantially support the user when the user, grasping both said bail grasping portions with separate hands, is substantially down in kneeling position or beginning to rise therefrom to a standing position, (f) the said relatively higher grasping portion of the other bail so positioned and located in height as to not require the initially standing user to stoop to grasp same with the other hand and to bear a preponderance of the user's weight and relatively more substantially support the user, when the user, grasping both said portions with separate hands, is beginning to kneel downwardly to the frame upper surface from a standing position or has substantially risen upwardly from the frame upper surface to a standing position, (g) there being two supporting leg members fixed to the underside of the frame and extending normally downwardly therefrom adapted to support the frame in a position spaced upwardly from a substantially horizontal supporting surface, (h) said leg members being positioned closely adjacent the side edges of the frame, normal to the width axis thereof and extending substantially the depth thereof, (i) said bail members being each substantially inverted U-shaped in a side view of the frame and substantially L and J-shaped in an end view of the frame and having the entire vertical length thereof laterally positioned of the side edges of said frame and also the lowermost, base portions thereof fixed to the underside of the frame and passing through said leg members, (j) there being a pair of wheels rotatably mounted next to one side edge of the frame outboard of the leg member adjacent the side edge, the downward extension of said wheels being less than the height of the leg members and the bail member positioned adjacent said wheels having a substantially relatively higher grasping portion thereon.

* * * * *